United States Patent [19]

Bell et al.

[11] Patent Number: 4,607,481

[45] Date of Patent: Aug. 26, 1986

[54] PROCESS FOR SPIRAL WRAPPING REINFORCEMENT FILAMENTS

[75] Inventors: Gilbert C. Bell; Harry W. Stanhope, both of Charlotte, N.C.

[73] Assignee: Celanese Corporation, New York, N.Y.

[21] Appl. No.: 676,442

[22] Filed: Nov. 29, 1984

Related U.S. Application Data

[62] Division of Ser. No. 415,100, Sep. 7, 1982, Pat. No. 4,516,394.

[51] Int. Cl.[4] ..... D07B 3/06; B65H 81/06

[52] U.S. Cl. ..... 57/3; 57/13; 57/7; 57/59

[58] Field of Search ..... 57/3, 6, 7, 13, 66, 57/72, 92, 93, 59, 62, 232, 233, 250, 251, 258, 292, 295–297, 309, 902; 28/178, 182, 183; 242/26.1, 26.5, 174–176

[56] References Cited

U.S. PATENT DOCUMENTS

| | | | |
|---|---|---|---|
| 395,363 | 1/1889 | Splitdorf | 57/13 X |
| 1,855,900 | 4/1932 | Bardsley | 57/3 |
| 1,943,716 | 1/1934 | Bardsley | 57/13 X |
| 2,072,284 | 3/1937 | Voorhees | 57/13 X |
| 2,481,619 | 9/1949 | Roessel | 242/26.5 |
| 3,106,056 | 10/1963 | Wise | 242/178 X |
| 3,111,803 | 11/1963 | Haugwitz | 57/13 |
| 3,368,343 | 2/1968 | Crook et al. | 57/243 |
| 3,413,797 | 12/1968 | Chapman | 57/243 |
| 3,563,017 | 2/1971 | Woolman | 57/13 |
| 3,736,739 | 6/1973 | Walter | 57/13 |
| 3,899,614 | 8/1975 | Okamoto et al. | 28/178 |
| 4,142,353 | 3/1979 | Greczin | 57/13 X |
| 4,407,116 | 10/1983 | Henrich | 57/13 |

*Primary Examiner*—Donald Watkins

*Attorney, Agent, or Firm*—Robert J. Blanke

[57] ABSTRACT

There is disclosed an improved feedstock package for a spiraling machine. The package comprises filamentary yarn having a twist of less than 5 tpi wound around a king spool. In contrast to prior art cone packages, the invention significantly reduces package distortion and threadline breakage in high speed spiraling operations employed in, for example, making reinforced plastic hose. Preferred embodiments include the yarn being greige yarn and the package rotational speeds on the spiraling machine being at least 1,400 rpm.

3 Claims, 8 Drawing Figures

PROCESS FOR SPIRAL WRAPPING REINFORCEMENT FILAMENTS

This is a division of application Ser. No. 415,100 filed Sept. 7, 1982, now U.S. Pat. No. 4,516,394.

BACKGROUND (i) Field of the Invention

This invention relates generally to packages of filamentary yarn used as feedstock for spiraling machines; process for making the packages; and process for using the packages; and the reinforced hose thereby obtained.

(ii) Prior Art

Spiralers are extremely old in the art. Spiralers are machines which form continuous spirals of yarn in a process that involves end-unwinding of the yarn from a feedstock package rotated at high speed. Commercial spiraling machines include those made by Knitting Machine Corp. of America, Entwistle and Sidney. Only recently have spiraling machines been developed that are capable of operating at 1,500 RPM as opposed to 700 RPM.

Reinforced hose, such as garden hose, automotive heater hose, and industrial hose, is typically manufactured by well-known processes in which a spiral of yarn formed by a spiraler is continuously coated with molten synthetic material or thermosetting elastomers. For example, see FIG. 3A described hereinafter and U.S. Pat. No. 4,155,790 (Galloway).

Prior art feedstock packages of yarn for spiralers, it is believed, have always been in the form of cones. For example, see spools S of FIG. 1 of U.S. Pat. No. 4,155,790. Further, the yarn, particularly polyester yarn formed from circular filaments, has generally been adhesive-treated yarn. This is partly because cones of untreated yarn, i.e., "greige" yarn, are incapable of performing satisfactorily at high package rotation speeds of around 1,000 rpm. It is also partly because about two thirds of reinforced hose made today has inadequate bond strength unless the yarn is adhesive-treated. It is well known that adhesive-treating of the yarn adds very significantly to its cost of production.

One type of yarn typically used in the manufacture of hose is conventional high tenacity polyester continuous filament yarn cross-wound onto a cone. Apparently, this type of yarn, a so-called industrial yarn, has never previously been wound onto a "king spool". King spools are extremely old in the art. A king spool may be defined as a spool that has one flange and only one flange, and the surface of the flange contacting the yarn is frustoconical. Thus, a cross-section of the yarn in the plane through the axis of the spool, is generally a parallelogram. See, for example, Ottko Textilmaschinen's technical leaflet "Precision Cone Winding Machine, NGS 10, for Sewing Threads", or Dietze Schell's equivalent bulletin. King spools have been used, for example, in packages of sewing thread yarn for at least twenty-five years. However, use of such sewing thread packages has apparently never involved either spiraling or rotation of the package, or yarn having a twist of less than 5 tpi.

SUMMARY OF THE INVENTION

In contrast to the forementioned prior art, there has now been discovered an improved feedstock yarn package of yarn for a spiraling machine which comprises filamentary yarn wound around a support, the yarn having a twist of less than 5 tpi, wherein the improvement comprises said rotatable support comprises a king spool. For many applications, it is preferred that the filamentary yarn comprises greige yarn, thus avoiding the cost of adhesive treating. However, the yarn may also be adhesive-treated. Accordingly, there has also been discovered an improved process for forming a package of yarn for use as a feedstock yarn for spiraling machines, wherein the improvement comprises winding filamentary yarn, having a twist of less than 5 tpi, onto a king spool.

In addition, there has been found an improved process for forming reinforced plastic hose comprising spiral wound filamentary reinforcing material, wherein the improvement comprises end-unwinding yarn from a king spool while rotating the package at a speed of at least 600 rpm.

DESCRIPTION OF THE PREFERRED EMBODIMENTS

The following examples and comparative examples demonstrate the advantages of the invention over the prior art.

EXAMPLES 1A–1C (Comparative)

These examples demonstrate that conventional greige high tenacity continuous filament yarn cross-wound onto a conventional cone is not a satisfactory source of yarn for use in a high speed spiraling operation.

Figure 3A:
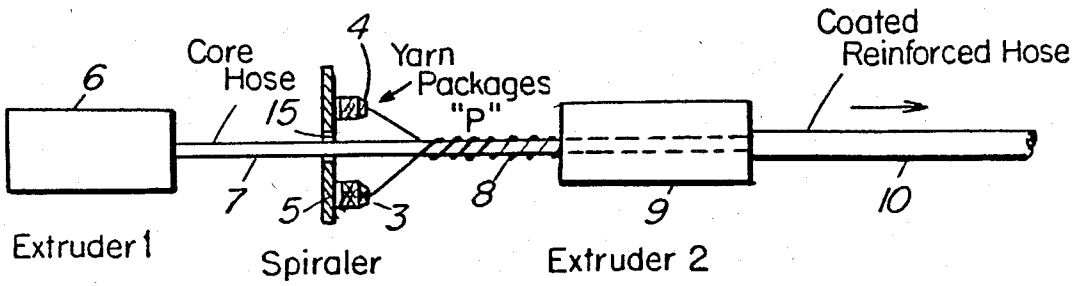
FIG. 3A is a simplified semi-schematic view in elevation of a process of the invention for making reinforced hose.
Figure 3B:
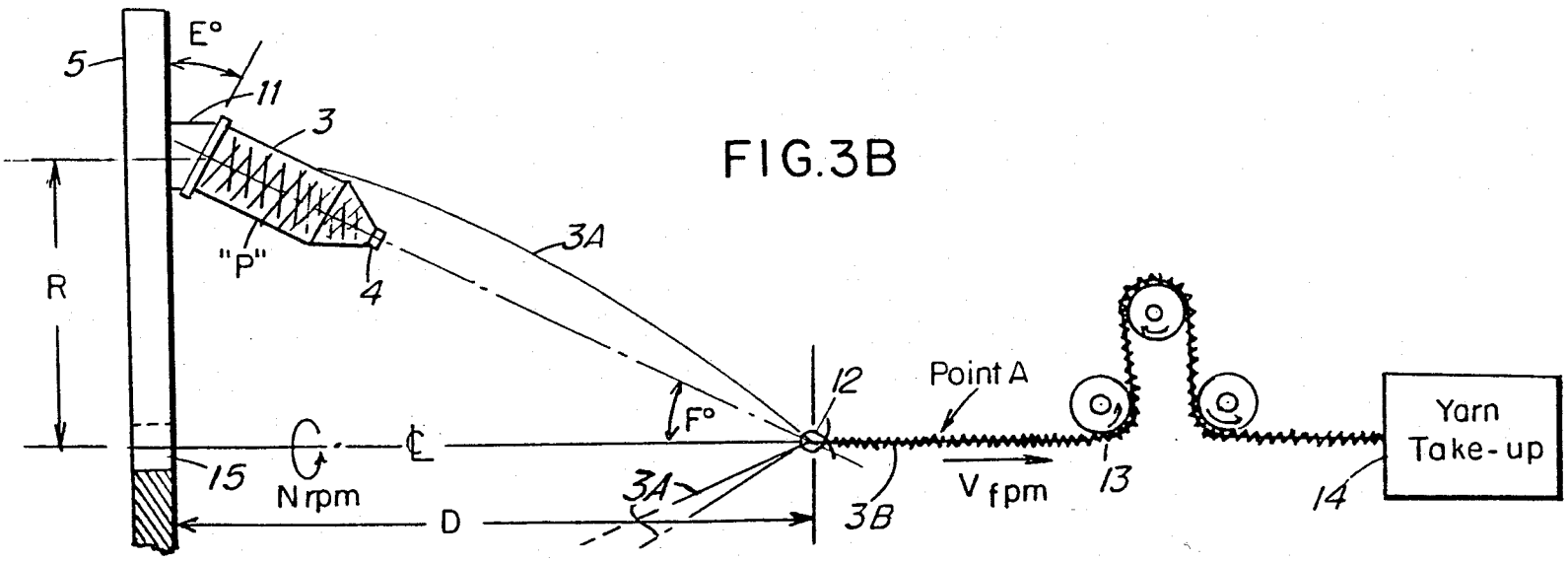
FIG. 3B is a simplified semi-schematic view in elevation of the experimental spiraling process employed in the examples of the invention.

At the outset, it should be noted that the processes used in these comparative examples (as well as the examples of the invention) were essentially similar to the process shown semi-schematically in FIG. 3B. FIG. 3B represents a "screening process" for evaluating feedstock packages "P" ultimately to be used in commercial processes for making reinforced hose, for example, by the process shown semischematically in FIG. 3A. The reasons for using the much simpler 3B-type process, rather than the 3A-type process are as follows.

FIG. 3A is a simplified semi-schematic elevation view of a continuous process for making reinforced hose. Essentially, core hose (7) is formed by a first extruder (6). The core hose is then wrapped with spirals of yarn (8), by passing the core hose through a central orifice (15) in a rotated rotable disc (5) of a spiraler on which disc's face are rigidly mounted a circular array of a plurality of yarn packages (3), from which yarn is continuously end-unwound by the advancing core hose. The wrapped core hose is then passed through a second extruder (9) that coats the wrapped hose to form coated reinforced hose. The coated reinforced hose may then be subjected to various processing steps not shown in FIG. 3A, but well known in the art. Such steps include, for example, curing, cooling, and reeling.

Customers' complaints had indicated that yarn breakage on the spiraler was a major problem when operating the type of process shown in FIG. 3A with conventional cones of greige polyester yarn on recently introduced spiralers in which the discs (and packages) were rotated at angular speeds of up to 1500 rpm, rather than 700 rpm.

The yarn breakage problem was clearly not associated with the downstream coating step by the second extruder. The problem was also believed to be essentially independent of variables associated with the core hose, particularly when the core hose had diameter of less than one inch.

Accordingly, it was concluded that the simple process shown in FIG. 3B could be used as a screening process for evaluating types of yarn packages for possible use in processes as shown in FIG. 3A.

Figure 4B:
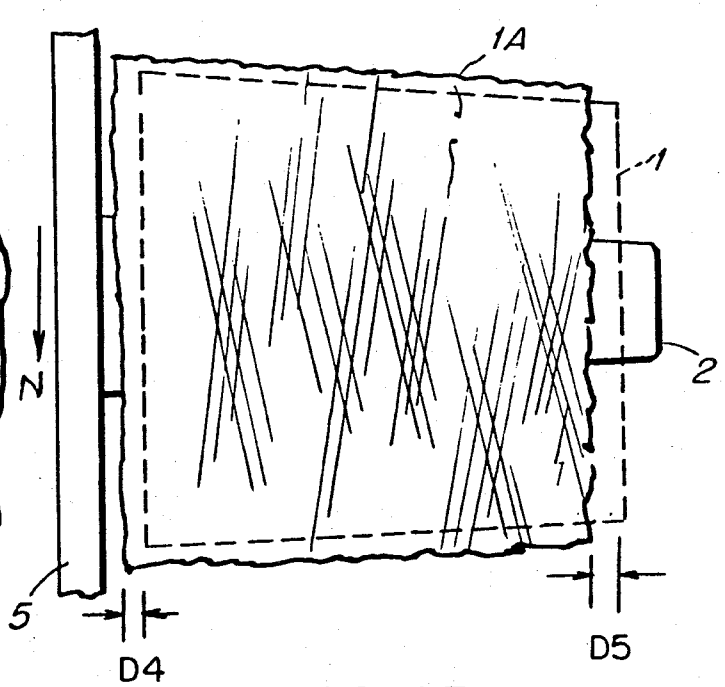
FIG. 4B (Prior Art)
FIGS. 4A and 4B are simplified front elevation and side elevation views respectively, of a prior art package of coned yarn, before and after being distorted by use of the experimental spiraling process employed in the comparative examples.
Figure 4A:
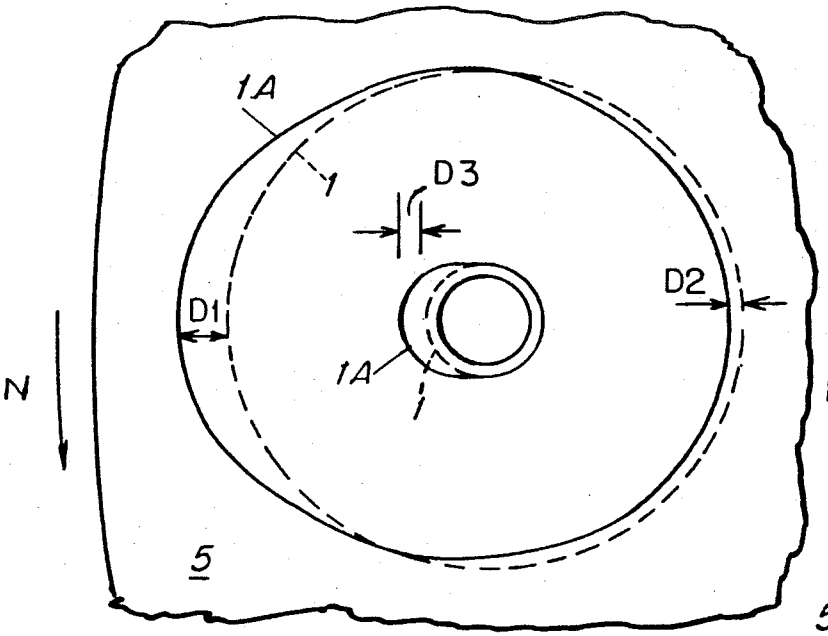
FIG. 4A (Prior Art)

FIG. 3B illustrates an experimental process in which feedstock yarn packages ("P") were evaluated. The particular package depicted in FIG. 3B corresponds to the king spool package of the invention depicted in FIGS. 2A and 2B. Essentially, three packages "P" (two not shown) were rigidly mounted on a spiraler's rotatable disc (5) via angling plates (11) and supporting mandrels (not shown). The axis of each package was inwardly inclined at an angle of F° to the axis of the disc. The axis of each package at its base was at a distance R from the axis of the disc. A pigtail convergence guide was positioned at the point of intersection of the axis of the disc and the axes of the packages. Yarn (3A) was strung up from each package through guide (12) to form a plied yarn (3B). The plied yarn was strung up around haul-off rolls (13) having a surface velocity of V fpm. The forwarded plied yarn was then collected by a yarn take-up (14), shown schematically. Disc (5) and the packages mounted thereon were rotated at an angular velocity of N rpm about the axis of the disc by conventional drive means that is not shown. In a typical screening process the experimental packages were initially run for a period of 5 minutes, or until one of the threadlines broke if earlier. Tension of the threadlines was measured at point "A" in FIG. 3B. Package dimensions were measured before and after the spiraling operation, and the extent of package distortion determined. For example, see FIGS. 4A and 4B described below. Package hardness was also measured before and after the spiraling operation.

Figure 1A:
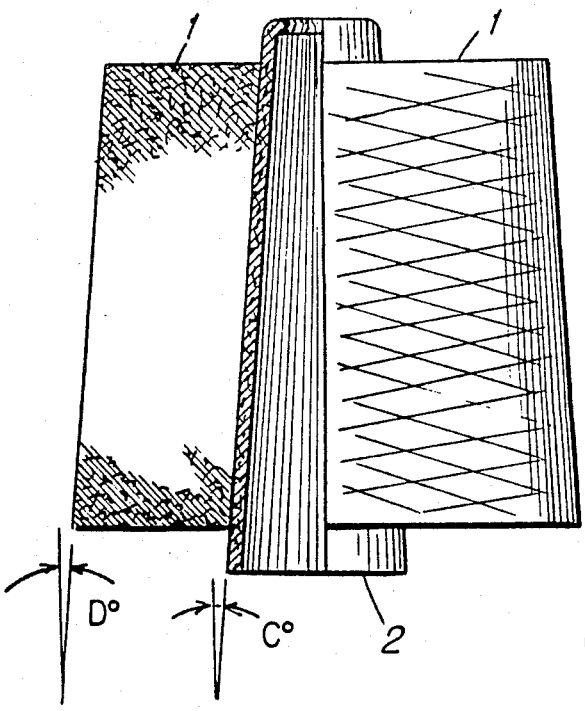
FIG. 1A (Prior Art)
FIGS. 1A and 1B are views of a prior art cone of yarn, in elevation and partial cross-section, and in plan, respectively.
Figure 1B:
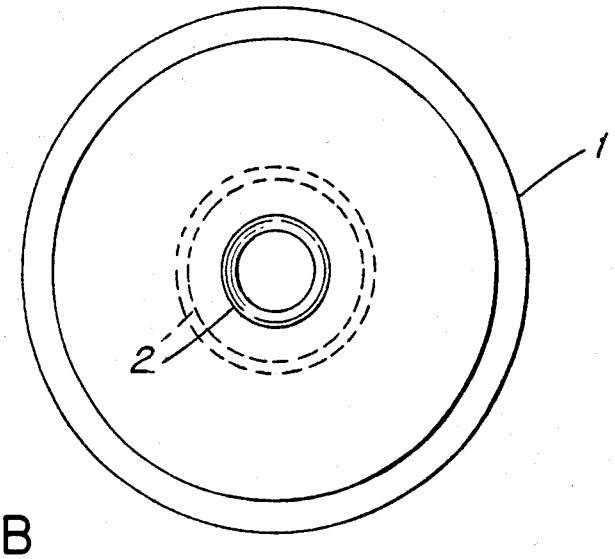
FIG. 1B (Prior Art)

Commercially available Fortrel® Type 800 polyester yarn was obtained which had properties in general accordance with "Celanese Fibers for Industry Manual", Product Description Sheet A/7 (October, 1981). Fortrel® Type 800 polyester is a compacted, high-tenacity, normal-shrinkage, thermally stabilized filament yarn used in tires, dryer felts, fire hose, conveyor belts, ropes, cordage, and plastic garden hose. Type 800 yarn has superior resistance to in-rubber strength loss from heat and steam hydrolysis. The package was in the form of a cone as shown in FIGS. 1A and 1B, with up to about 7 pounds of yarn (1) on the cardboard cone (2) having a wall thickness of 7/32 inches. The cone angle (C°) was 3°51'. The wound yarn had a diameter of about 7 inches and length of about 6 inches. The yarn had a total denier of 1000; a filament count of 192; tenacity of 8.9 gpd; breaking load of 19.8 pounds; elongation at break of 13.5 percent; initial modulus of 115 gpd; and hot air shrinkage of 11.5 percent at 350° F. (177° C.). The packages had been formed by rewinding on a conventional Leesona 861 coning machine, with the yarn being end-unwound from packages in which the compacted yarn had been cross-wound around tubes of about 6 inch outer diameter. Accordingly, the coned yarn had a real twist of less than 0.06 tpi. None of the yarn had been adhesive-treated.

The foregoing cone packages were evaluated for spiralability performance in the manner described above for FIG. 3B, over a range of package rotational speeds on a conventional spiraling machine, made for laboratory purposes by Sidney Tool and Die Incorporated, Sidney, Ohio. The machine is a simplified form of commercial units and has, for example, facility for spiraling only three packages of yarn. Typical operating conditions and test results are given in Table 1. The distance R in FIG. 3B was 18 inches in all these trials. The package distortion data in Table 1 for these cone packages should be read in conjunction with FIGS. 4A and 4B. Severe distortion occurred even at 600 rpm. Threadline breakage seemed to be associated with trapping of the yarn resultant from the severe distortion of the packages and yarn sloughing. Package hardness was measured with a Textile Durometer Model T-2 made by Strassburg Engineering, at Scale 4, before and after the spiraling operation. Yarn tension at point "A" was typically about 150–200 grams on average, in contrast to the 19.8 pound breaking load of each threadline. However, there was pronounced tension fluctuation, particularly at the higher speeds and at the higher levels of distortion of the package.

Clearly the foregoing packages were also unsuitable as feedstock packages for the type of process shown in FIG. 3A. Yarn breakage cannot be tolerated because of the difficult start-up procedure in the continuous process. Even tension fluctuations in the spiraled yarn can cause distortion in the hose tube and excessive variability in the properties of the final cured reinforced hose.

EXAMPLE 2A–2C

These examples illustrate the advantages of using feedstock yarn packaged on a king spool rather than the cone of Example 1.

Processes were performed in a manner similar to Comparative Example 1, except that the commercially available Fortrel® Type 800 polyester industrial yarn was originally re-packaged onto a king spool rather than onto a cone. In particular, a Leesona 51 winder machine was used to re-wind the yarn onto king spools, thereby forming packages having the following dimensions.

Figure 2A:
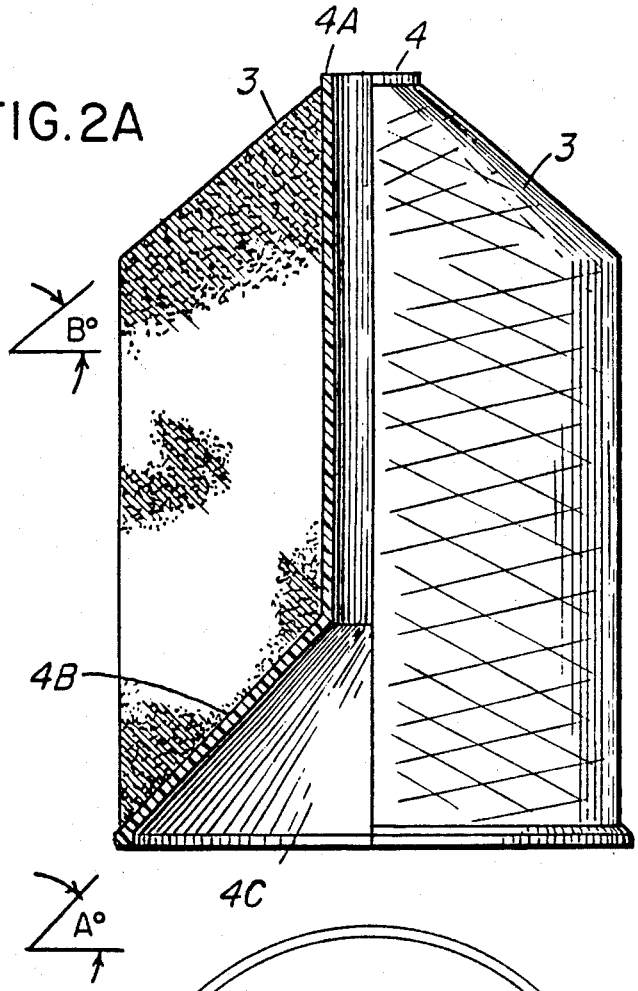
FIGS. 2A and 2B are views of the package of the invention, in elevation and partial cross-section, and in plan, respectively.
Figure 2B:
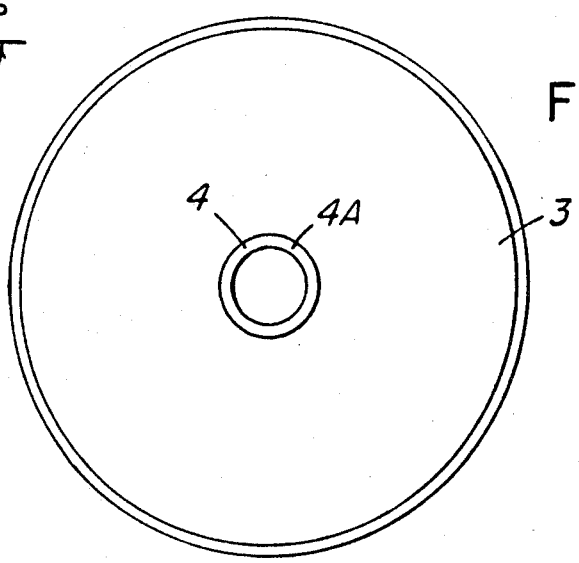

The packages conformed to FIGS. 2A and 2B, except for scale. Each king spool (4) had been molded from plastic (most were polyethylene, some were polypropylene). Each king spool consisted essentially of a tube (4A) of $\frac{1}{8}$ inch wall thickness and outer diameter $1\frac{1}{4}$ inches; a flange (4B) inclined at angle (A° ) of 45°; and a rim (4C) having a diameter of 6 inches. The shape of the yarn (3) in cross-section was essentially a parallelogram, with the angle B° also being about 45°, even though the yarn edge remote from the flange was slightly convex. The yarn was cross-wound at a helix angle of approximately 10°. All packages were wound with a 6 inch traverse length.

Typical experimental results are tabulated in part of Table 1. In addition, it was found that average yarn tensions at point "A" in FIG. 3B were also around 150–200 grams. However, yarn tension fluctuations were significantly lower than in the respective comparative examples, and no yarn breaks whatsoever were encountered. There was extremely little distortion of the yarn on the package at points corresponding to those shown for the cone package in FIGS. 4A and 4B. Also the package retained its original hardness or even increased in hardness, apparently as a result of the high centrifugal forces (e.g. of 7000 lb) compressing the yarn against the supporting v-flange.

Clearly these king spool packages appear to be eminently suitable for use in the commercial reinforced hose process illustrated in FIG. 3A. Further, it is believed that the packages would also be suitable for spiraling processes having rotation rates far higher than the highest capability of existing spiraling machines.

TABLE 1

| Ex. No. | Package Type | E° and F° | N rpm | Range of V fpm | Typical Package Distortion (inches) $D_1$ | $D_2$ | $D_3$ | $D_4$ | $D_5$ | Typical Package Hardness Before | After | Time of First Break of Yarn |
|---|---|---|---|---|---|---|---|---|---|---|---|---|
| 1A | Cone | 15 | 600 | 50–250 | 0.75 | 0.87 | 0 | 0.12 | 0.12 | 85 | — | <60 min |
| 1B | Cone | 15 | 1000 | 50–250 | 1.06 | 0.37 | 0.25 | 0.25 | 0.25 | 85 | 72 at top 81 at bottom | <5 min |
| 1C | Cone | 15 | 1400 | 50–250 | 1.08 | 0.40 | 0.30 | 0.30 | 0.30 | 85 | 72 at top 81 at bottom | <5 min |
| 2A | King Spool | 15 | 600 | 50–250 | 0.01 | 0 | 0 | 0 | 0.02 | 85 | 85 | none related to package |
| 2B | King Spool | 15 | 1000 | 50–250 | 0.03 | 0.01 | 0 | 0 | 0.04 | 85 | 87 | none related to package |
| 2C | King Spool | 15 | 1400 | 50–250 | 0.04 | 0.01 | 0 | 0 | 0.08 | 85 | 87 | none related to package |

While the examples of the invention all relate to polyester industrial yarn, it is clear that the scope of the invention is not so limited. All industrial synthetic reinforcing yarns, including nylon industrial yarn, come within the scope of the invention. Further, flexible yarns comprising fine metallic filaments also come within the scope of the invention. Clearly, the invention is not limited to the examples.

The following conditions represent the preferred embodiments of the invention.

The filamentary yarn preferably has a twist of less than 3 tpi; and more preferably less than 1 tpi.

The filamentary yarn preferably has a tenacity greater than 5 gpd; and more preferably greater than 8 gpd.

The invention has utility with both greige yarn and yarn comprising adhesive material within the range from 1 to 8 percent by weight.

While the invention has utility when commercially available circular filaments are used, it might be preferable to use non-circular filaments, particularly at very high rotational speeds of several thousand rpm.

It is preferred that the yarn be polyester continuous multifilament yarn with total denier in the range from 500 to 10,000 and dpf's from 2 to 12. However, yarns having a staple component may also be used with advantage.

The yarn-contacting frustoconical flange of the king spool preferably has an angle to the spool's axis within the range from 30° to 60°.

It is preferred that the yarn be cross-wound onto the king spool at a helix angle within the range from 5° to 30°.

The tubular portion (4A) of the king spool shown in FIG. 2A could be replaced by a slightly conical portion, but it is preferred to use a tubular portion.

The process for forming a spiral wind from the package of the invention is preferably greater at a package rotation speed of at least 1,000 rpm; and more preferably at least 1,400 rpm.

While all the examples relate to a single yarn end wound on a king spool, it might on occasion be preferable to have multiple ends wound on the spool. Such multiple end packages could result in greater productivity of the process for winding the yarn on to the king spools. Also such multiple end packages would allow the spiraling process to provide greater coverage of the tube surface. Thus a small spiraler with limited package positions could be used to reinforce a hose of large diameter.

We claim:

1. An improved process for forming a spiral wind of filamentary reinforcing material by end-unwinding at least one package of yarn eccentrically mounted on a centrally supported rotatable disc of a spiraling machine, and rotating the disc wherein the improvement comprises:

unwinding a package comprising a rotatable support and filamentary yarn wound around the support, the filamentary yarn having a twist of less than 5 tpi and the rotatable support comprising a king spool, and rotating said package about the disc's center line at least 600 rpm.

2. The process of claim 1 wherein said rotational speed is at least 1000 rpm.

3. The process of claim 1 wherein said rotational speed is at least 1400 rpm.

* * * * *